US010310415B1

(12) United States Patent
Schoell

(10) Patent No.: US 10,310,415 B1
(45) Date of Patent: Jun. 4, 2019

(54) SYSTEM AND METHOD FOR REMOVING PINS FROM A PRINT CARTRIDGE

(71) Applicant: Clover Technologies Group, LLC, Ottawa, IL (US)

(72) Inventor: Laurence A. Schoell, Shorewood, IL (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 0 days.

(21) Appl. No.: 15/955,369

(22) Filed: Apr. 17, 2018

(51) Int. Cl.
*G03G 15/00* (2006.01)
*G03G 21/18* (2006.01)
*G03G 15/08* (2006.01)

(52) U.S. Cl.
CPC ..... *G03G 15/0894* (2013.01); *G03G 21/181* (2013.01); *G03G 2215/00987* (2013.01); *G03G 2221/1876* (2013.01)

(58) Field of Classification Search
CPC ..... G03G 15/0894; G03G 21/181; G03G 21/1821; G03G 21/1825; G03G 2215/00987; G03G 2221/1876
See application file for complete search history.

(56) References Cited

U.S. PATENT DOCUMENTS 5,406,355 A * 4/1995 Komuro ..... G03G 21/1821 399/111
6,327,448 B1 * 12/2001 Sasaki ..... G03G 21/181 399/111
2008/0145096 A1 * 6/2008 Tsui ..... G03G 21/1821 399/113
2009/0290903 A1 * 11/2009 Horikawa ..... G03G 21/185 399/111
2011/0142487 A1 * 6/2011 Anan ..... G03G 21/1825 399/109
2017/0108827 A1 4/2017 Kusano et al.

OTHER PUBLICATIONS

Hewlett Packard LaserJet 4000 (HP4000) Remanufacturing Instructions by Static Control Components, Inc. (1998).

* cited by examiner

*Primary Examiner* — Sophia S Chen
(74) *Attorney, Agent, or Firm* — Michael Best & Friedrich LLP

(57) ABSTRACT

A toner cartridge disassembly machine for at least partially disassembling a toner cartridge. The toner cartridge includes a toner hopper and a waste hopper coupled to the toner hopper via a first pin and a second pin. The first pin is removably coupled within a first connection joint and the second pin is removably coupled within a second connection joint. The disassembly machine includes a base, a docking station supported by the base and capable of receiving the toner cartridge, and a carrier frame movably coupled to the base. The disassembly machine further includes a pin removal arm supported by the carrier frame. The pin removal is movable into a position between the first connection joint and the second connection joint. The pin removal arm includes a first push-out pin configured to interact with the first pin and a second push-out pin configured to interact with the second pin.

20 Claims, 9 Drawing Sheets

SYSTEM AND METHOD FOR REMOVING PINS FROM A PRINT CARTRIDGE

BACKGROUND

The application generally relates to imaging, or printer, cartridges.

SUMMARY

Printing systems, such as high volume printing devices (e.g., network printers, photocopiers, etc.), typically use toner cartridges which store and transmit toner to an intended medium, such as paper. Once the toner has depleted, the used toner cartridge is removed from the printing system, and typically disposed of. Remanufacturing of used toner cartridges permits the toner cartridges to be reused rather than disposed of in landfills.

Toner cartridges come in a variety of configurations. Although specific constructions vary among manufacturers and printers, many toner cartridges include components such as a toner hopper, a waste hopper, and a variety of toner-regulating blades, a developer roller, a primary charge roller, and an organic photo-conductor drum.

To avoid discarding useful materials and to thereby reduce the environmental impact of printing operations, many toner cartridges may be remanufactured. Remanufacturing involves collecting used toner cartridges that, prior to their use, were brand new cartridges typically supplied by the manufacturer of the printer with which the cartridges are compatible. These cartridges are often referred to in the art as "OEM cartridges" because they are supplied by the original equipment manufacturer, i.e., the manufacturer of the printer and the compatible printer cartridge.

Remanufacturing of toner cartridges typically includes, among other things, disassembling the toner cartridge, cleaning the toner cartridge, refilling the toner hopper with new toner, repairing or replacing worn or damaged components, and reassembling the toner cartridge.

In one embodiment, the invention provides a method of disassembling a used toner cartridge having a toner hopper and a waste hopper coupled to the toner hopper via a first pin and a second pin. The first pin is removably coupled within a first connection joint and the second pin is removably coupled within a second connection joint. The method includes the steps of (a) providing a pin removal arm having a first push-out pin and a second push-out pin; (b) positioning the pin removal arm between the first connection joint and the second connection joint; (c) displacing the first pin of the toner hopper relative to the first connection joint with the first push-out pin by moving the pin removal arm towards the first pin; and (d) displacing the second pin of the toner hopper relative to the second connection joint with the second push-out pin by moving the pin removal arm towards the second pin.

In another embodiment, the invention provides a toner cartridge disassembly machine for at least partially disassembling a toner cartridge. The toner cartridge includes a toner hopper and a waste hopper coupled to the toner hopper via a first pin and a second pin. The first pin is removably coupled within a first connection joint and the second pin is removably coupled within a second connection joint. The disassembly machine includes a base, a docking station supported by the base and capable of receiving the toner cartridge, and a carrier frame movably coupled to the base. The disassembly machine further includes a pin removal arm supported by the carrier frame. The pin removal is movable into a position between the first connection joint and the second connection joint. The pin removal arm includes a first push-out pin configured to interact with the first pin and a second push-out pin configured to interact with the second pin.

Other aspects of the invention will become apparent by consideration of the detailed description and accompanying drawings.

DETAILED DESCRIPTION

Before any embodiments of the application are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
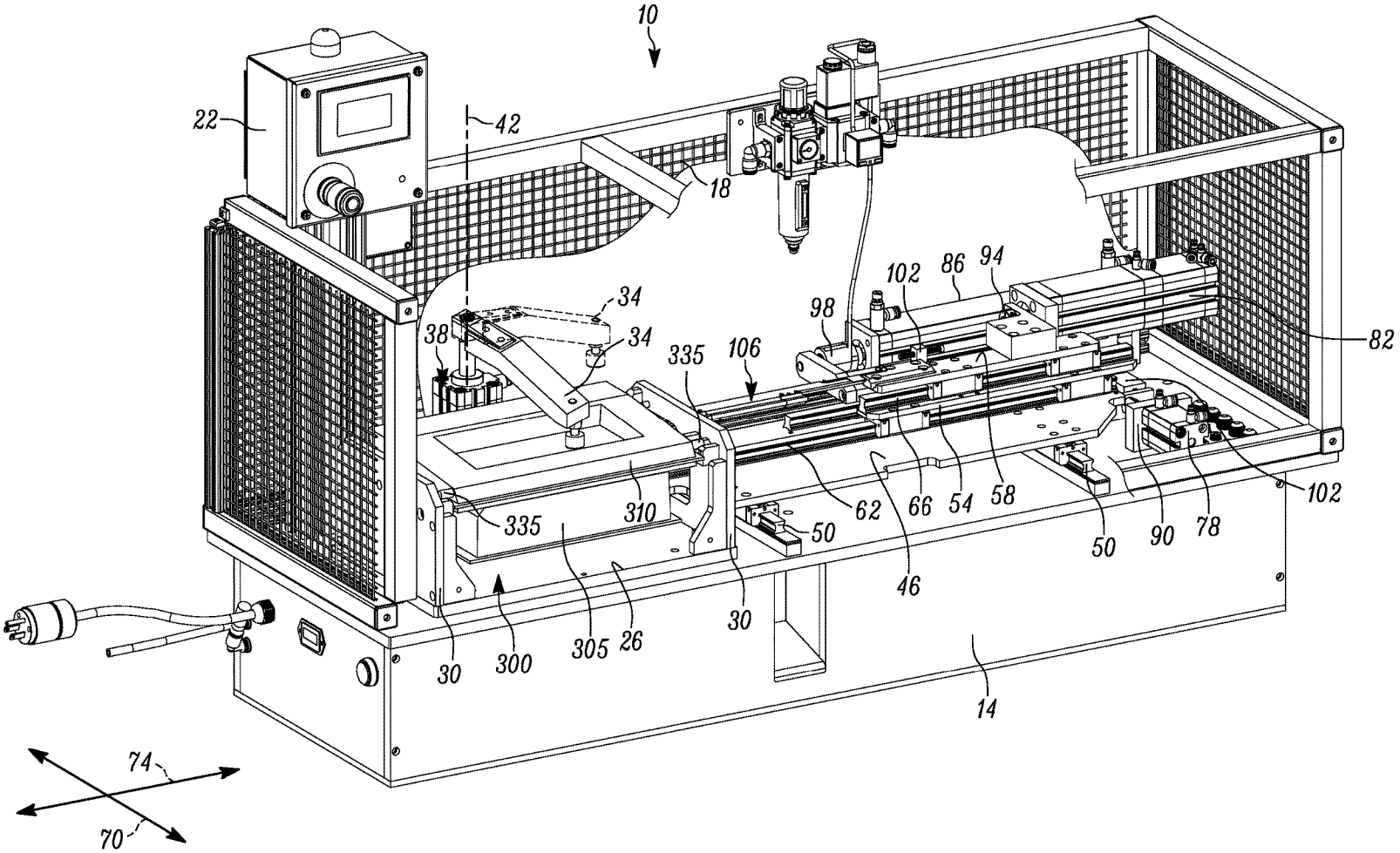
FIG. 1 is a perspective view of a toner cartridge disassembly machine according to some embodiments of the application, illustrating a toner cartridge supported therein.

FIG. 1 illustrates a toner cartridge disassembly machine 10 according to some embodiments of the application. The toner cartridge disassembly machine 10 is configured to at least partially dissemble a toner cartridge 300 during operation of the machine 10, as described in further detail below. The toner cartridge 300 is a consumable component used in a printing system (e.g., network printers, laser printers, photocopiers, etc.). The toner cartridge 300 stores and, in cooperation with components of a compatible printer, transfers toner to an intended medium (e.g., paper).

Figure 2:
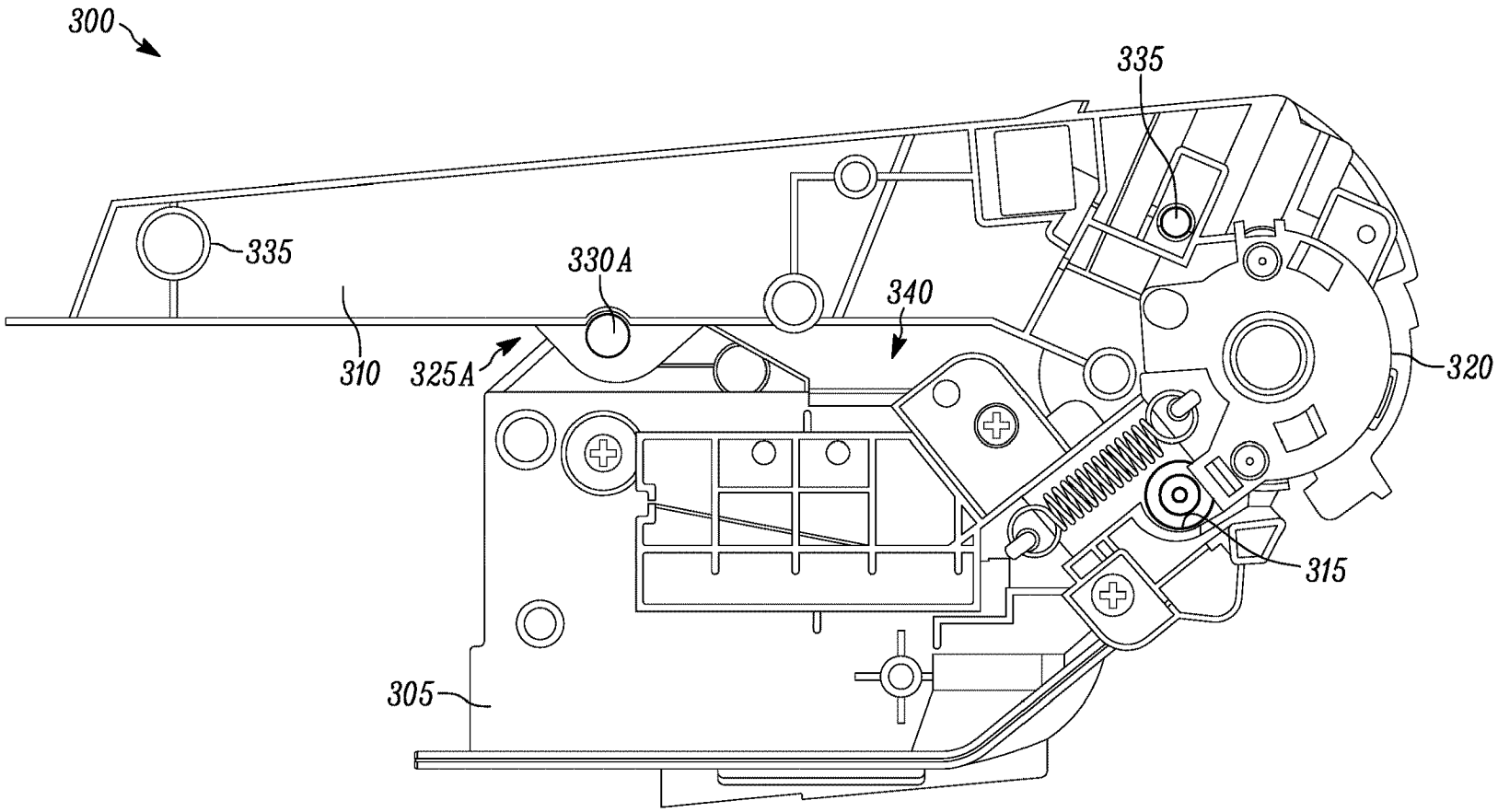
FIG. 2 is a side plan view of the toner cartridge of FIG. 1.

The toner cartridge 300 of FIG. 2 is an "all-in-one" cartridge and includes the following components or elements: a toner hopper 305 for storing a mass of toner; a waste hopper 310 for storing residual toner; a developer roller (i.e., a magnetic roller or a developer unit) 315; an organic photo-conductor (OPC) drum 320; and a primary charge roller (not shown) adjacent the OPC drum 320. The illustrated toner cartridge 300 further includes a wiper blade embedded within the waste hopper 310 and disposed adjacent the OPC drum 320. The wiper blade contacts the OPC drum 320 and wipes residual toner (i.e., toner remaining on the OPC drum 320 after transfer to the intended medium) from the OPC drum 320. The wiped residual toner is collected by a waste hopper 310. The toner hopper 305 is pivotably connected to the waste hopper 310 via connection joints 325A, 325B (although only one is shown in FIG. 2).

A pair of pins 330A, 330B (FIG. 5) are selectively received within corresponding connection joints 325A, 325B to couple the toner hopper 305 to the waste hopper 310. The pins 330A, 330B are co-axially aligned along a pin axis 338. As shown, a void or air gap 340 exists between the toner hopper 305 and the waste hopper 310 in the space between the OPC drum 320 and the joints 325A, 325B.

During a printing sequence, toner is collected from the toner hopper 305 by the rotating developer roller 315 and magnetically or electrostatically transferred from the developer roller 315 to the OPC drum 320. A laser system having a laser beam, located within the printing system, scans an electrostatic image onto the OPC drum 320 with the laser beam. In some printers, the electrostatic image produced by the laser corresponds to the image to be printed. In other printers, the laser forms an electrostatic image that is a negative of the image that is to be printed. Regardless of the specific configuration, toner carried by the developer roller 315 is electrostatically attracted to the electrostatic image produced on the OPC drum 320 by the laser beam. The OPC drum 320 then applies the toner, which is in a pattern corresponding to the desired image, onto the intended medium by direct contact or by further electrostatic transfer. The toner is then fused to the intended medium, typically by way of a heating element (e.g., a fuser).

Figure 3:
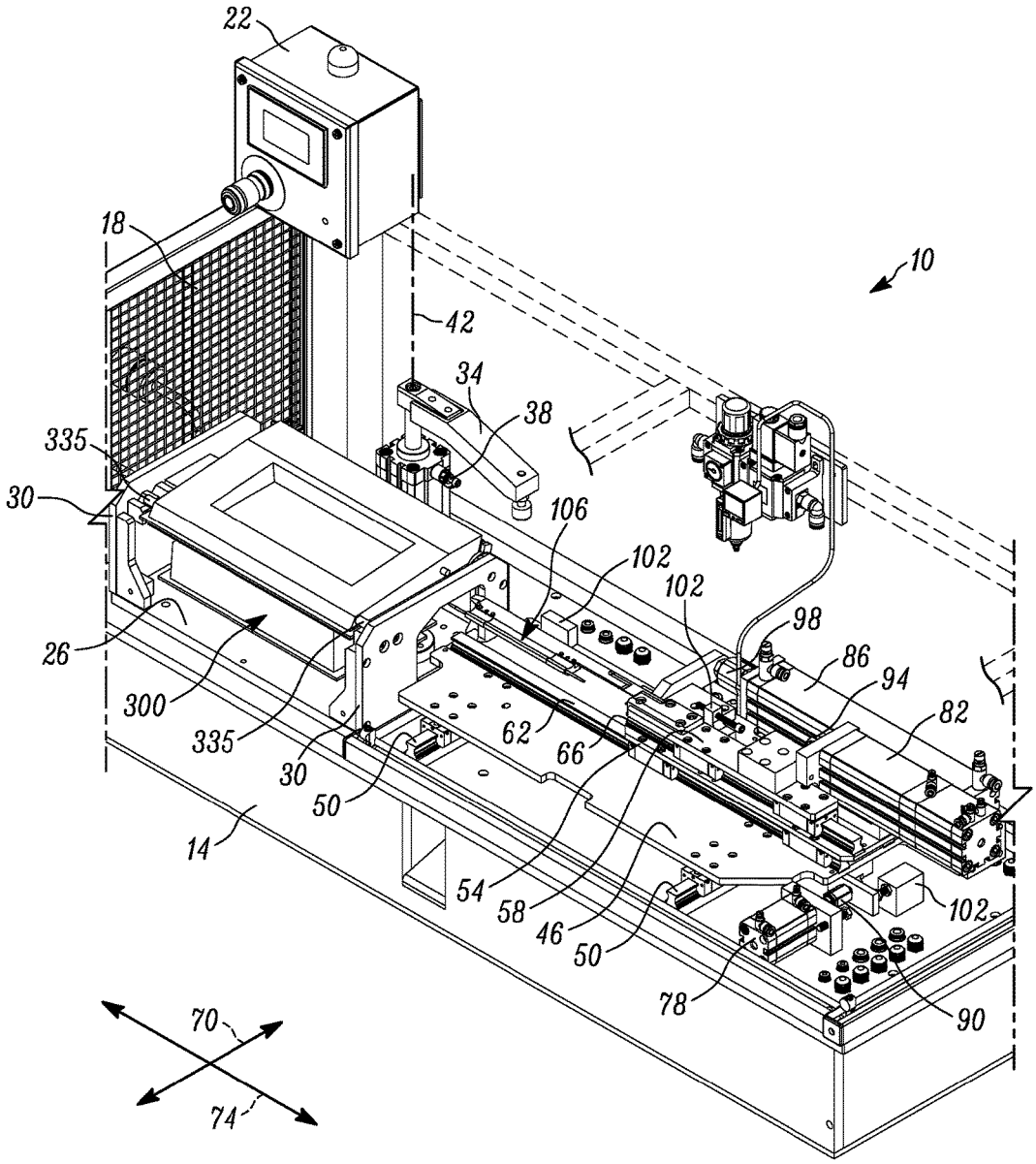
FIG. 3 is an enlarged perspective view of the toner cartridge disassembly machine, illustrating a main carrier frame and a pin removal arm.

With reference to FIGS. 1 and 3, the toner cartridge disassembly machine 10 includes a base 14, a protection screen 18 extending upward from the base 14, and a user control interface 22 where an operator is able to input various parameters to initiate a pin removal sequence. The disassembly machine 10 further includes a cartridge docking station 26 that receives and temporarily supports the toner cartridge 300 during operation. Specifically, the toner cartridge 300 includes posts 335 extending away from the waste hopper 310 that are supported within the docking station 26 by a pair of upright walls 30. The upright walls 30 effectively create a cradle for the posts 335 to rest upon. Once the posts 335 are resting atop the upright walls 30, the toner cartridge 300 is supported in an elevated position relative to the base 14 and inhibited from inadvertent lateral movement. The docking station 26 is configured to receive different sizes of toner cartridges while ensuring consistent positioning of the gap 340 within the docking station 26.

The cartridge docking station 26 further includes a locking arm 34 that is pneumatically driven by a locking arm actuator 38 to secure the toner cartridge 300 in the docking station 26. The locking arm actuator 38 defines a locking arm axis 42 along which the locking arm 34 moves and rotates about. As shown in FIG. 1, the locking arm 34 is in a blocking position (shown in solid lines), in which the locking arm 34 is in contact with and effectively interferes with the toner cartridge 300 from being removed from the docking station 26. When the toner cartridge 300 is ready to be removed from the docking station 26, the locking arm 34 is moved to an unblocking position (shown in phantom lines). Specifically, the locking arm 34 is actuated vertically away from the toner cartridge 300 along the locking arm axis 42, and subsequently rotated (approximately 90 degrees) about the locking arm axis 42 until the locking arm 34 is positioned outside of the vertical footprint of the toner cartridge 300 for ease of removal of the cartridge 300. Although the locking arm actuator 38 is defined as a pneumatic actuator, the actuator 38 may alternately be a different type of suitable actuator.

With continued reference to FIGS. 1 and 3, the toner cartridge disassembly machine 10 further includes a main carrier frame 46 movably coupled to the base 14 via guide rails 50 and a pair of auxiliary carrier frames 54, 58 movably supported on the main carrier frame 46. Specifically, the first auxiliary carrier frame 54 is movably coupled to the main carrier frame 46 via guide rails 62, while the second auxiliary carrier frame 58 is movably coupled to the first auxiliary carrier frame 54 via guide rails 66. The main carrier frame 46 is capable of sliding in the y-direction (as denoted by arrow 70) on rails 50 and both the first and second auxiliary carrier frames 54, 58 are capable of sliding in the x-direction (as denoted by arrow 74) on rails 62, 66, respectively. As such, the first and second auxiliary carrier frames 54, 58 move perpendicular relative to the main carrier frame 46. With that said, the first auxiliary carrier frame 54 moves in a direction parallel relative to the second auxiliary carrier frame 58. The guide rails 50, 62, 66 of the illustrated embodiment are conventional linear slide rails with corresponding dry bearing mounts captured on the linear slide rails. In other embodiments, ball bearing mounts may alternatively be coupled to the linear slide rails.

The main carrier frame 46 includes three separate pneumatic actuators—a first actuator 78 fixedly coupled between the base 14 and the main carrier frame 46, a second actuator 82 fixedly coupled between the main carrier frame 46 and the first auxiliary carrier frame 54, and a third actuator 86 fixedly coupled between the first and second auxiliary carrier frames 54, 58. When activated, a piston rod 90 of the first actuator 78 moves the main carrier frame 46 along the guide rails 50 in the y-direction. Similarly, a piston rod 94 of the second actuator 82 moves the first auxiliary carrier frame 54 along the guides rails 62 in the y-direction and a piston rod 98 of the third actuator 86 moves the second auxiliary carrier frame 58 along the guide rails 66 in the y-direction. Although originally defined as pneumatic actuators, the actuators 78, 82, 86 may alternately be a different type of suitable actuator.

With reference to FIG. 3, limit screws 102 are provided in the movement path of each actuator 78, 82, 86 to limit the range of motion of each actuator 78, 82, 86 within a predetermined distance. The limit screws 102 are capable of being adjusted to change the predetermined distance that each actuator 78, 82, 86 is permitted to travel. The limit screws 102 of the illustrated embodiment are "hard-stops", such that the limit screws 102 interfere and inhibit movement of the actuators 78, 82, 86 beyond the predetermined distance that is set. In other embodiments, the limit screws 102 may alternatively be limit switches that send an electronic signal to a controller, resulting in deactivation of the corresponding actuator 78, 82, 86 upon contact with the limit switches.

Figure 4:
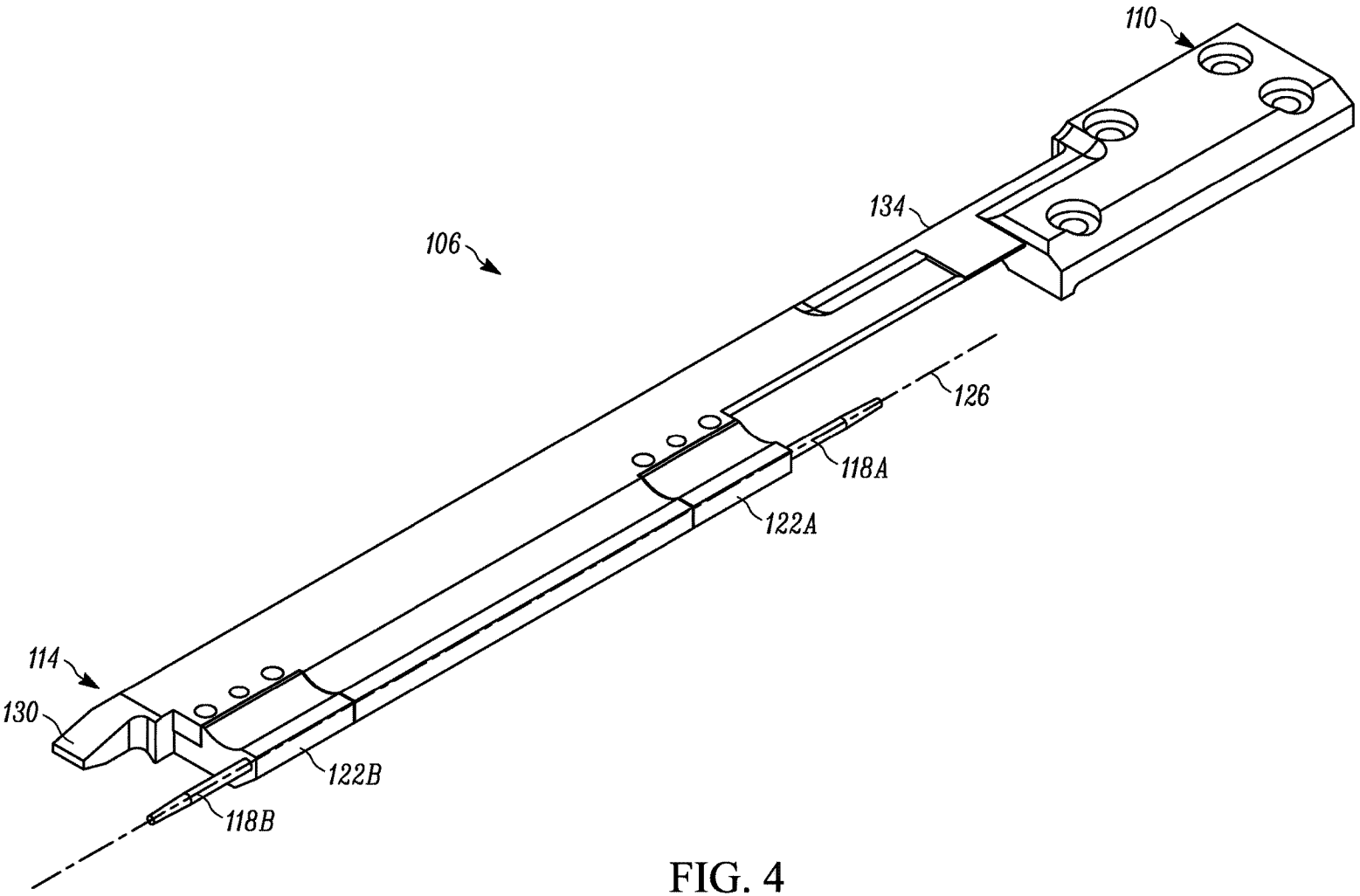
FIG. 4 is a perspective view of the pin removal arm of FIG. 3.

With reference to FIG. 4, the toner cartridge disassembly machine 10 further includes a pin removal arm 106 that is coupled to and movable with the second auxiliary carrier frame 58. In fact, the pin removal arm 106 is cantilevered away from the second auxiliary carrier frame 58 along the x-direction 74, such that a first end 110 of the pin removal arm 106 is rigidly fixed to the second auxiliary carrier frame 58, whereas a distal second end 114 of the pin removal arm 106 is unsupported and spaced away in the x-direction 74 from the second auxiliary carrier frame 58. The pin removal arm 106 is parallel to the rails 66 and includes a pair of push-out pins 118A, 118B removably coupled to the pin removal arm 106 through respective pin housings 122A, 122B. The pin housings 122A, 122B are fastened to the pin removal arm 106 with screws, bolts, or other suitable fasteners so that the pin housings 122A, 122B (and therefore the push-out pins 118A, 118B) are capable of being replaced in the event of inadvertent damage to either of the push-out pins 118A, 118B. The push-out pins 118A, 118B are co-axially aligned along an arm axis 126, which extends in a direction of longitudinal extent of the pin removal arm 106. The pin removal arm 106 further includes a wedge-shaped tip 130 disposed at the second end 114 of the pin removal arm 106. The wedge-shaped tip 130 aids in guiding the pin removal arm 106 into the gap 340 of the toner cartridge 300 as the pin removal arm 106 moves along the x-direction 74. In other words, the wedge-shaped tip 130 decreases the likelihood of inadvertent jamming between the pin removal arm 106 and the toner cartridge 300 during insertion of the pin removal arm 106 into the gap 340. A recessed portion 134 is disposed adjacent the first end 110, which also decreases the likelihood of inadvertent jamming between the pin removal arm 106 and the toner cartridge 300. But in this case, the recessed portion 134 provides clearance when the pin removal arm 106 is already received in the gap 340 and the pin removal arm 106 moves in the y-direction 70 relative to the toner cartridge 300. The recessed portion 134 includes a slimmer profile than the remainder of the pin removal arm 106 to provide clearance between portions of the toner cartridge 300 and the pin removal arm 106.

Figure 5:
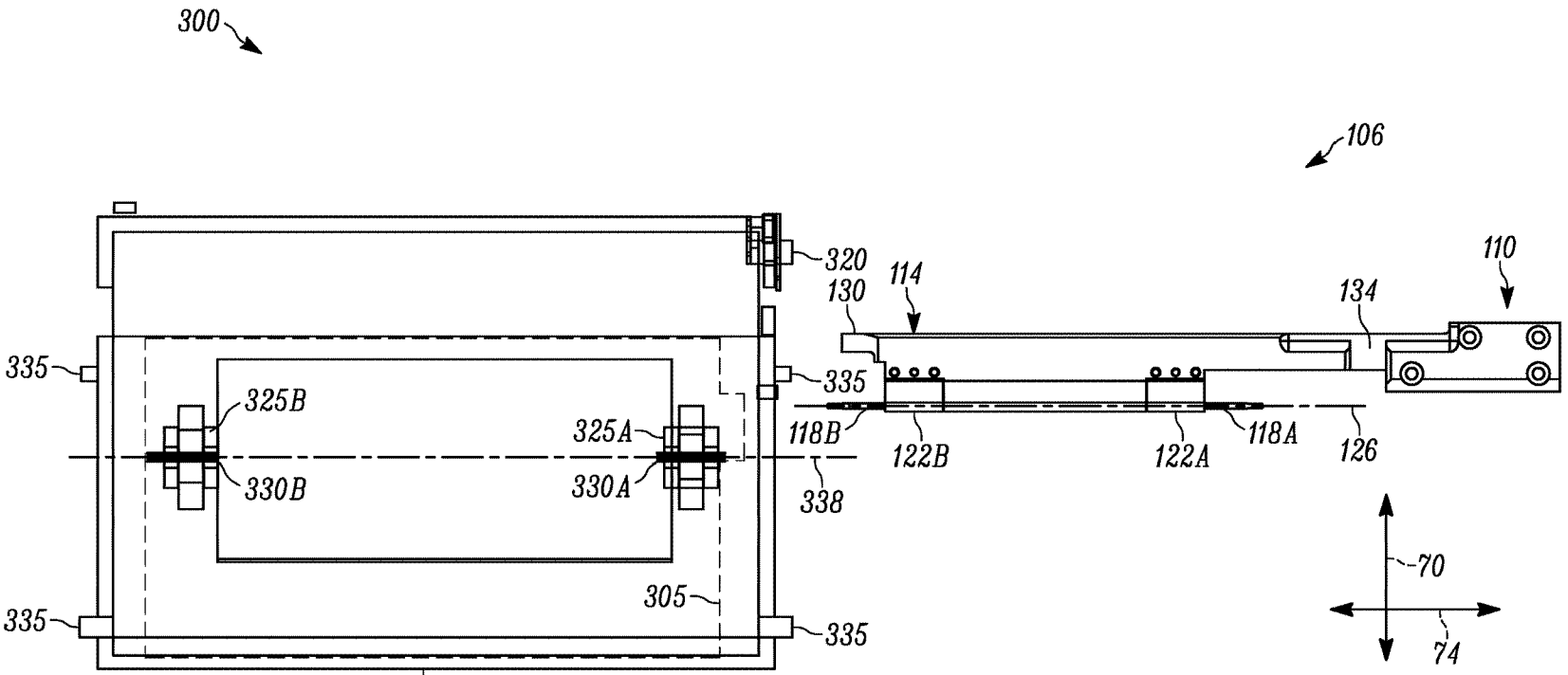
FIG. 5 is a top view of the pin removal arm adjacent the toner cartridge.

In operation, the pin removal arm 106 is operable to remove (or at least partially displace) the pins 330A, 330B of the toner cartridge 300 in order to facilitate separation of the toner hopper 305 from the waste hopper 310. In many cases, refurbishing of any print cartridge is simplified by complete or partial disassembly of the print cartridge. This holds true for the toner cartridge 300, such that portions of the toner cartridge 300 are preferably disassembled to initiate a refurbishment process. As illustrated in FIG. 5, the pin removal arm 106 is in a default or "homed" position and the toner cartridge 300 is positioned within docking station 26. In the homed position, the pin removal arm 106 is outside the vertical footprint of the toner cartridge 300 and the arm axis 126 is axially aligned with the gap 340 of the print cartridge 300. As such, the pin axis 338 and the arm axis 126 are parallel (i.e., axially offset) relative to each other. The locking arm 34 is in the blocked position at this time (as shown in solid lines of FIG. 1).

Figure 6:
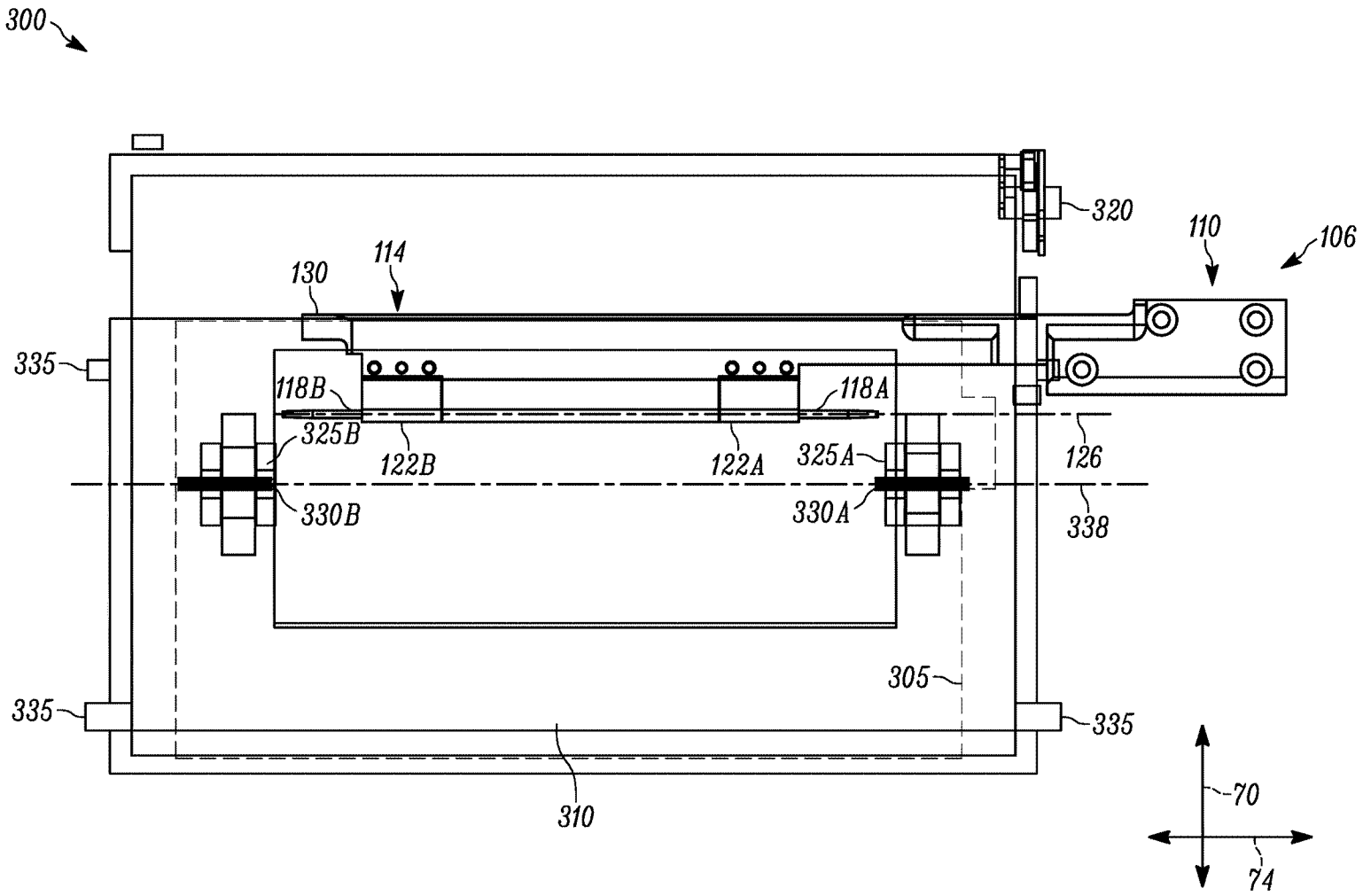
FIG. 6 is a top view of the pin removal arm inserted through a gap existing within the toner cartridge.

To initiate a pin removal sequence, the first auxiliary carrier frame 54 is actuated relative to the main carrier frame 46 via the second actuator 82 along the x-direction 74 towards the toner cartridge 300. Since the second auxiliary carrier frame 58 is supported on the first auxiliary carrier frame 54, the second auxiliary carrier frame 58 moves with first auxiliary carrier frame 54. The first auxiliary carrier frame 54 is actuated a predetermined distance (set by the associated limit screws 102) that corresponds to the pin removal arm 106 being actuated through the gap 340 and positioned underneath waste hopper 310 of the toner cartridge 300, as shown in FIG. 6.

Figure 7:
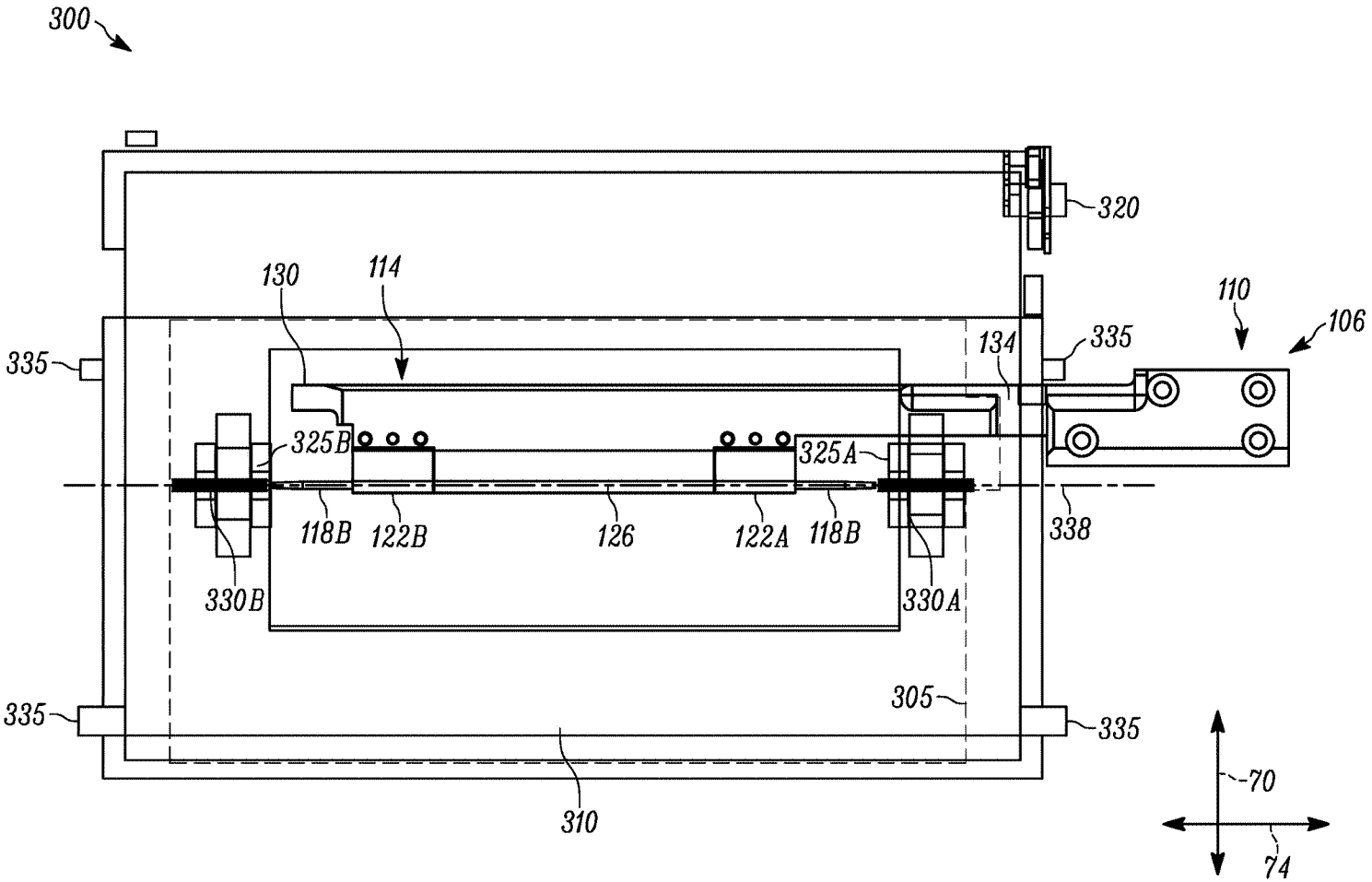
FIG. 7 is a top view of the pin removal arm being co-axially aligned with a pair of pins of the toner cartridge.

With reference to FIG. 7, the pin removal arm 106 is moved in the y-direction 70 until the arm axis 126 of the pin removal arm 106 is co-axially aligned with the pin axis 338 of the toner cartridge 300. To accomplish this, the main carrier frame 46 is actuated relative to the base 14 via the first actuator 78 along the y-direction 70 until the actuator 78 or main carrier frame 46 abuts the relevant limit screws 102. When the pin removal arm 106 is moved in the y-direction 70, the recessed portion 134 enables the pin removal arm 106 to avoid contact with a portion of the waste hopper 310.

Figure 8:
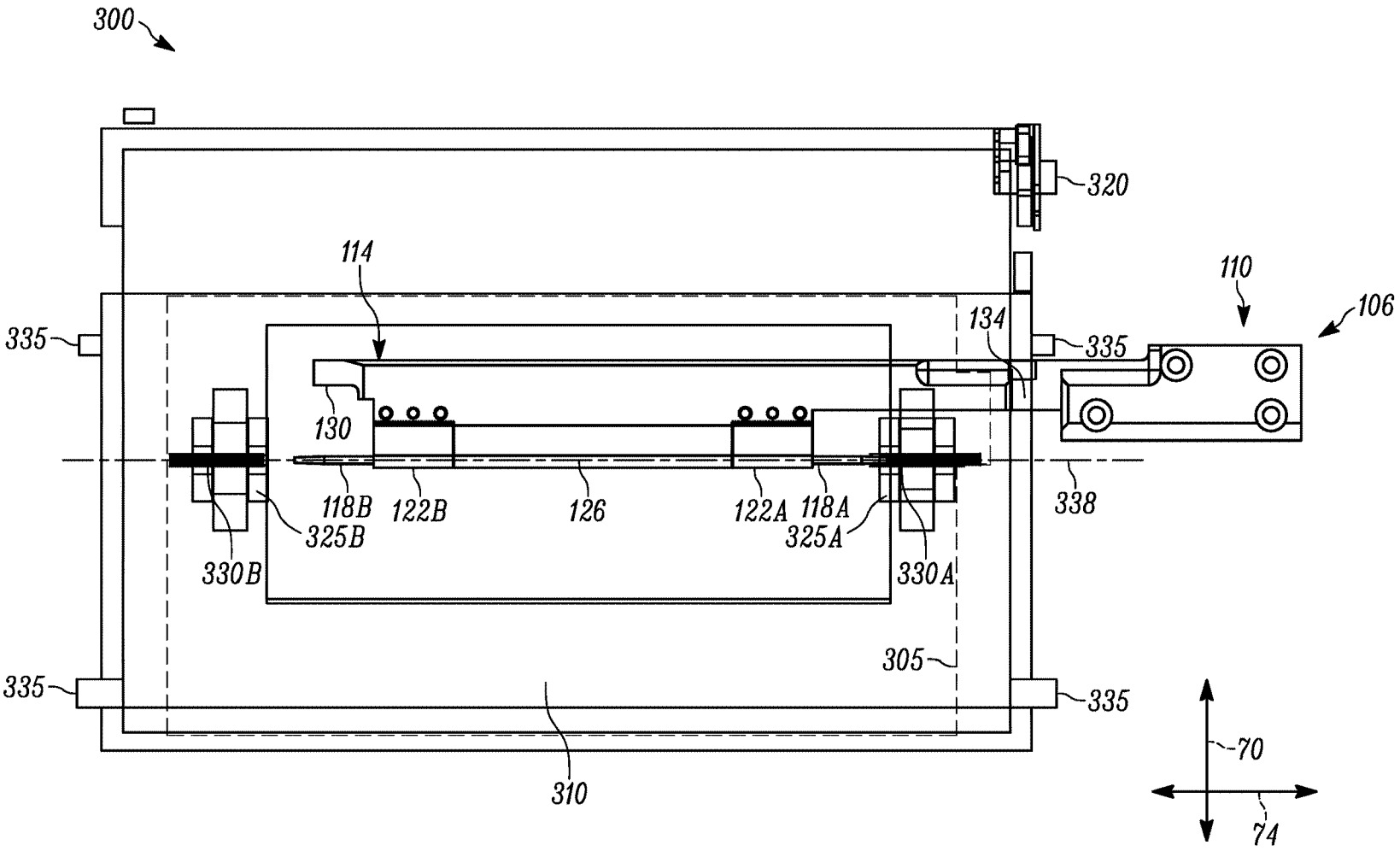
FIG. 8 is a top view of the pin removal arm displacing one of the pins relative to the toner cartridge.
Figure 9:
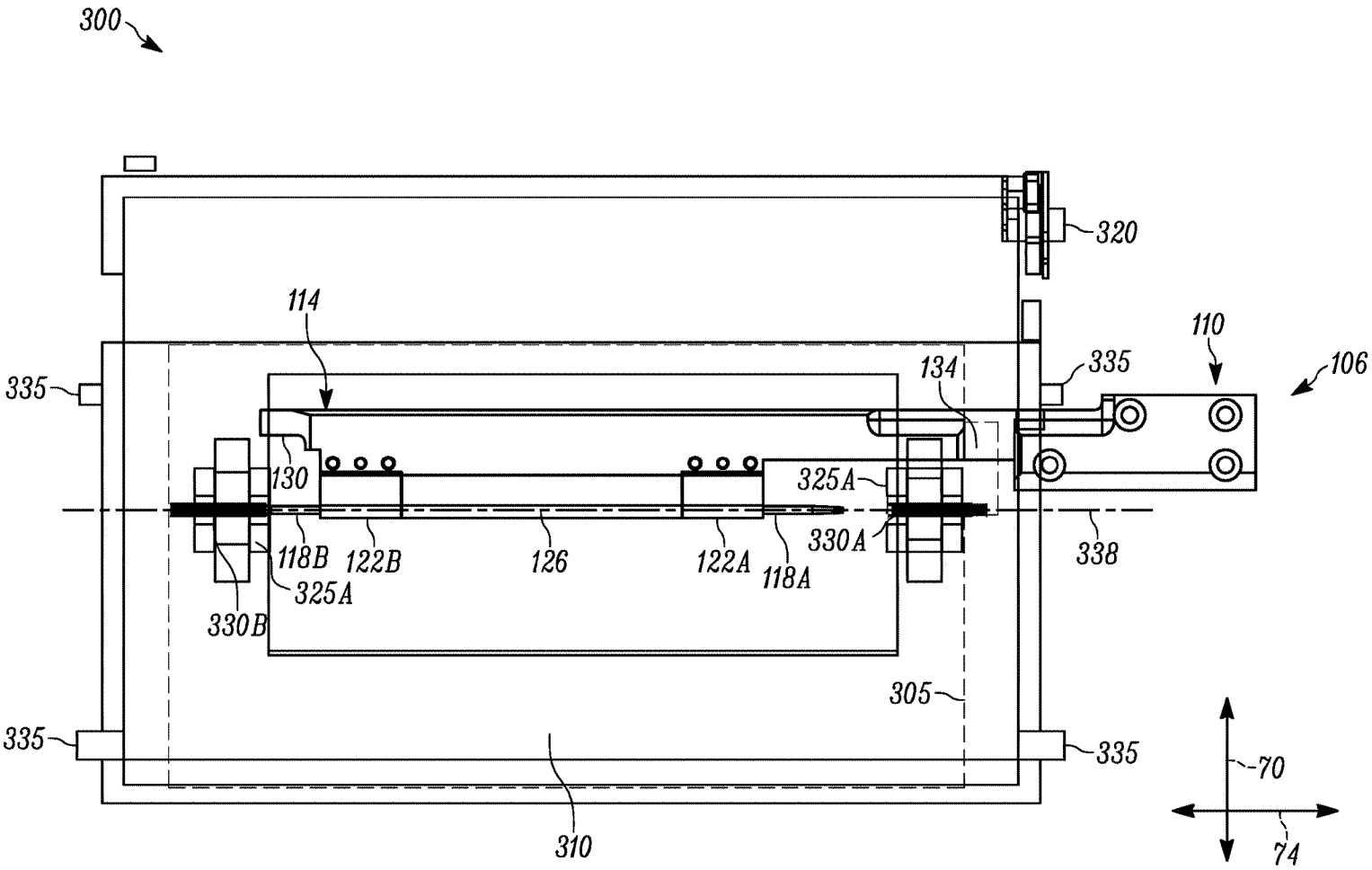
FIG. 9 is a top view of the pin removal arm displacing the other one of the pins relative to the toner cartridge.

With reference to FIG. 8, the pin removal arm 106 is actuated along the arm axis 126 towards the pin 330A via the second auxiliary carrier frame 58 and the third actuator 86. The push-out pin 118A of the pin removal arm 106 contacts the pin 330A and at least partially displaces the pin 330A from the connection joint 325A. Subsequently, the pin removal arm 106 is actuated in the opposite direction along the arm axis 126 towards the pin 330B, as shown in FIG. 9. To accomplish this, the pin removal arm 106 is actuated by the second auxiliary carrier frame 58 and the third actuator 86. The push-out pin 118B contacts the pin 330B and at least partially displaces the pin 330B from the connection joint 325B. The amount which the push-out pins 118A, 118B displaces the pins 330A, 330B from the connection joint 325A, 325B is determined by the position of the limit screws 102 relative to the third actuator 86. Specifically, the push-out pin 118A stops displacing the pin 330A when the piston rod 98 of the third actuator 86 abuts one of the limit screws 102. Similarly, the push-out pin 118B stops displacing the pin 330B when the piston rod 98 of the third actuator 86 abuts another one of the limit screws 102. Although the pins 330A, 330B are only partially displaced, in other embodiments, the pins 330A, 330B may alternatively be completely removed from the connection joints 325A, 325B.

At this point, the pin removal arm 106 is re-actuated along the arm axis 126 until the push-out pin 118A merely touches (but does not exert a pushing force) the pin 330A, corresponding to the piston rod 98 of the third actuator 86 abutting the limit screw 102. As the piston rod 98 touches the limit screw 102, the third actuator 86 now has a "zeroed" reference point that the third actuator 86 uses to properly reposition the pin removal arm 106 in-between the connection joints 325A, 325B, such that neither of the push-out pins 118A, 118B are in interference with the connection joints 325A, 325B. With the pin removal arm 106 properly positioned between the connection joints 325A, 325B, the main carrier frame 46 is now actuated in the y-direction via the first actuator 78 to realign the pin removal arm 106 with the gap 340 of the toner cartridge 300. Finally, the first auxiliary carrier frame 54 is actuated along the x-direction via the second actuator 82 to remove the pin removal arm 106 from underneath the waste hopper 310 through the gap 340 until the pin removal arm 106 is in the homed position (FIG. 5). The locking arm 34 is returned to the unblocking position (FIG. 3), providing clearance for removal of the toner cartridge 300 from the docking station 26. The pins 330A, 330B are now removed from the connection joints 325A, 325B by hand with the use of pliers or similar tool to avoid losing or misplacing the pins 330A, 330B. This way, the same pins 330A, 330B can be reused during reassembly of the toner cartridge 300.

Thus, the invention provides, among other things, a system and method of remanufacturing a toner cartridge. Various features and advantages of the invention are set forth in the following claims.

What is claimed is:

1. A method of disassembling a used toner cartridge having a toner hopper and a waste hopper coupled to the toner hopper via a first pin and a second pin, wherein the first pin is removably coupled within a first connection joint and the second pin is removably coupled within a second connection joint, the method comprising the steps of:

(a) providing a pin removal arm having a first push-out pin and a second push-out pin;

(b) positioning the pin removal arm between the first connection joint and the second connection joint;

(c) displacing the first pin of the toner hopper relative to the first connection joint with the first push-out pin by moving the pin removal arm towards the first pin; and (d) displacing the second pin of the toner hopper relative to the second connection joint with the second push-out pin by moving the pin removal arm towards the second pin.

2. The method of claim 1, wherein the toner cartridge includes a gap disposed between the toner hopper and the waste hopper, the method further comprising aligning the pin removal arm with the gap using a first actuator.

3. The method of claim 2, further comprising actuating the pin removal arm into the gap using a second actuator.

4. The method of claim 1, wherein positioning the pin removal arm between the first connection joint and the second connection joint includes actuating the pin removal arm using a first actuator.

5. The method of claim 1, wherein steps (c) and (d) include actuating the pin removal arm using an actuator.

6. The method of claim 1, wherein the first pin and the second pin are co-axially aligned with one another along a pin axis, and wherein the first push-out pin and the second push-out pin are substantially axially aligned with one another along an arm axis, the method further comprising actuating the pin removal arm using a first actuator to co-axially align the arm axis with the pin axis.

7. The method of claim 1, wherein step (c) includes displacing the first pin of the toner hopper by exerting a force on the first pin using the first push-out pin of the pin removal arm.

8. The method of claim 1, wherein step (d) further includes displacing the second pin of the toner hopper by exerting a force on the second pin using the second push-out pin of the pin removal arm.

9. The method of claim 1, further comprising inhibiting movement of the toner cartridge relative to the pin removal arm during a pin removal sequence.

10. A toner cartridge disassembly machine for at least partially disassembling a toner cartridge, the toner cartridge including a toner hopper and a waste hopper coupled to the toner hopper via a first pin and a second pin, wherein the first pin is removably coupled within a first connection joint and the second pin is removably coupled within a second connection joint, the disassembly machine comprising:

a base;

a docking station supported by the base and capable of receiving the toner cartridge;

a carrier frame movably coupled to the base;

a pin removal arm supported by the carrier frame and movable into a position between the first connection joint and the second connection joint, the pin removal arm including a first push-out pin configured to interact with the first pin and a second push-out pin configured to interact with the second pin.

11. The disassembly machine of claim 10, further comprising a first actuator coupled to the carrier frame for moving the carrier frame along a first direction, and a second actuator coupled to the carrier frame for moving the carrier frame along a second direction that is substantially perpendicular to the first direction.

12. The disassembly machine of claim 11, wherein the toner cartridge defines a gap disposed between the toner hopper and the waste hopper, and wherein the pin removal arm is actuatable through the gap of the toner cartridge along the first direction, and wherein the pin removal arm is actuatable along the second direction to move the pin removal arm into the position between the first connection joint and the second connection joint.

13. The disassembly machine of claim 11, further comprising a third actuator for moving the pin removal arm along the first direction to cause the first push-out pin to interact with the first pin and to cause the second push-out pin to interact with the second pin.

14. The disassembly machine of claim 11, wherein the first actuator and the second actuator are both pneumatic actuators.

15. The disassembly machine of claim 11, wherein the first actuator includes a first piston rod movable along a first movement path when actuating the carrier frame and the second actuator includes a second piston rod movable along a second movement path when actuating the carrier frame, and further comprising a first limit screw disposed along the first movement path to limit a range of motion of the first piston rod within a first predetermined distance and a second limit screw disposed along the second movement path to limit a range of motion of the second piston rod within a second predetermined distance.

16. The disassembly machine of claim 10, further comprising a locking arm supported by the base and disposed adjacent the docking station, wherein the locking arm is movable between a blocking position, in which the locking arm inhibits removal of the toner cartridge from the docking station, and an unblocking position, in which the toner cartridge is permitted to be removed from the docking station.

17. The disassembly machine of claim 10, wherein the first and second push-out pins are removably coupled to the pin removal arm.

18. The disassembly machine of claim 10, wherein the first push-out pin of the pin removal arm interacts with the first pin by exerting a force on the first pin to displace the first pin relative to the first connection joint.

19. The disassembly machine of claim 18, wherein the second push-out pin of the pin removal arm interacts with the second pin by exerting a force on the second pin to displace the second pin relative to the second connection joint.

20. The disassembly machine of claim 10, wherein the carrier frame is movable relative to the base along a first direction and along a second direction perpendicular to the first direction, wherein the carrier frame is guided along the first direction via a first guide rail, and wherein the carrier frame is guided along the second direction via a second guide rail that is perpendicular to the first guide rail.

* * * * *